United States Patent [19]

Brown

[11] 3,997,200

[45] Dec. 14, 1976

[54] SLIDE BOLT LATCH FOR SLIDING WINDOW VENT

[75] Inventor: Roscoe M. Brown, Seattle, Wash.

[73] Assignee: Belknap Glass Company, Seattle, Wash.

[22] Filed: May 21, 1975

[21] Appl. No.: 579,304

[52] U.S. Cl. ..... 292/145; 292/DIG. 46

[51] Int. Cl.[2] ..... E05C 1/04

[58] Field of Search ..... 49/449, 450; 70/100; 292/138, 153, 154, DIG. 38, DIG. 46, DIG. 47, DIG. 61

[56] References Cited

UNITED STATES PATENTS

| | | | |
|---|---|---|---|
| 80,295 | 7/1868 | Lotridge | 292/153 |
| 2,065,615 | 12/1936 | Schlage | 292/153 |
| 2,950,136 | 8/1960 | Pengelly | 292/64 |
| 3,508,777 | 4/1970 | McBurnie | 292/254 |
| 3,768,205 | 10/1973 | Grossman | 49/450 |

*Primary Examiner*—Richard Moore
*Assistant Examiner*—A. Craig
*Attorney, Agent, or Firm*—Seed, Berry, Vernon & Baynham

[57] ABSTRACT

A latch has a slide bolt for sliding along a guideway in a sliding window vent in a window frame and has a handle unit interfitting with the slide bolt. This handle unit is formed with a leaf spring engaging the back wall of the guideway to urge the handle unit forwardly so that when the slide bolt registers with an aperture in the window frame, a portion of the handle unit fits into a stop recess at the mouth of the guideway.

13 Claims, 5 Drawing Figures

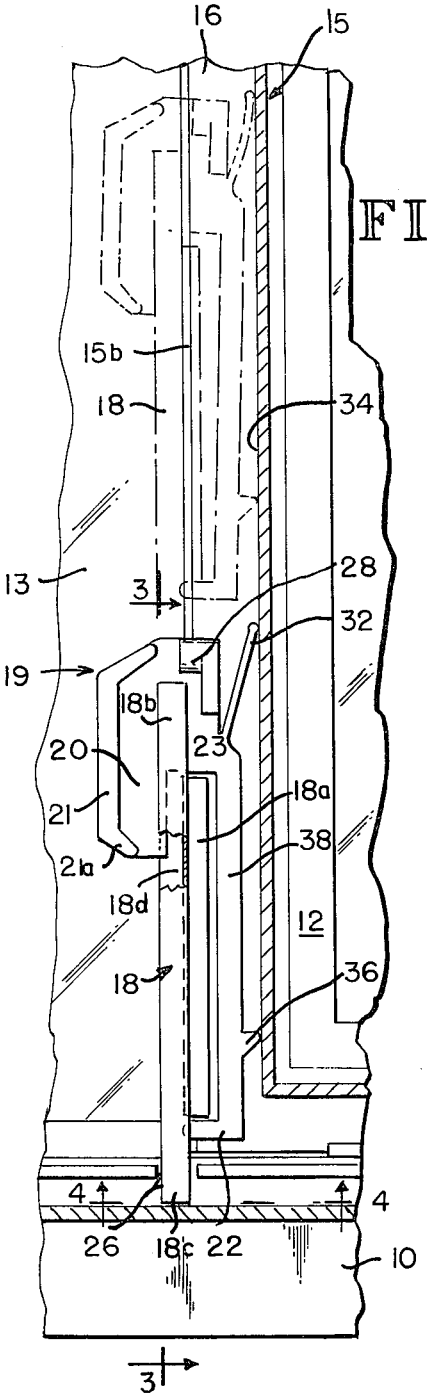
FIG. 2
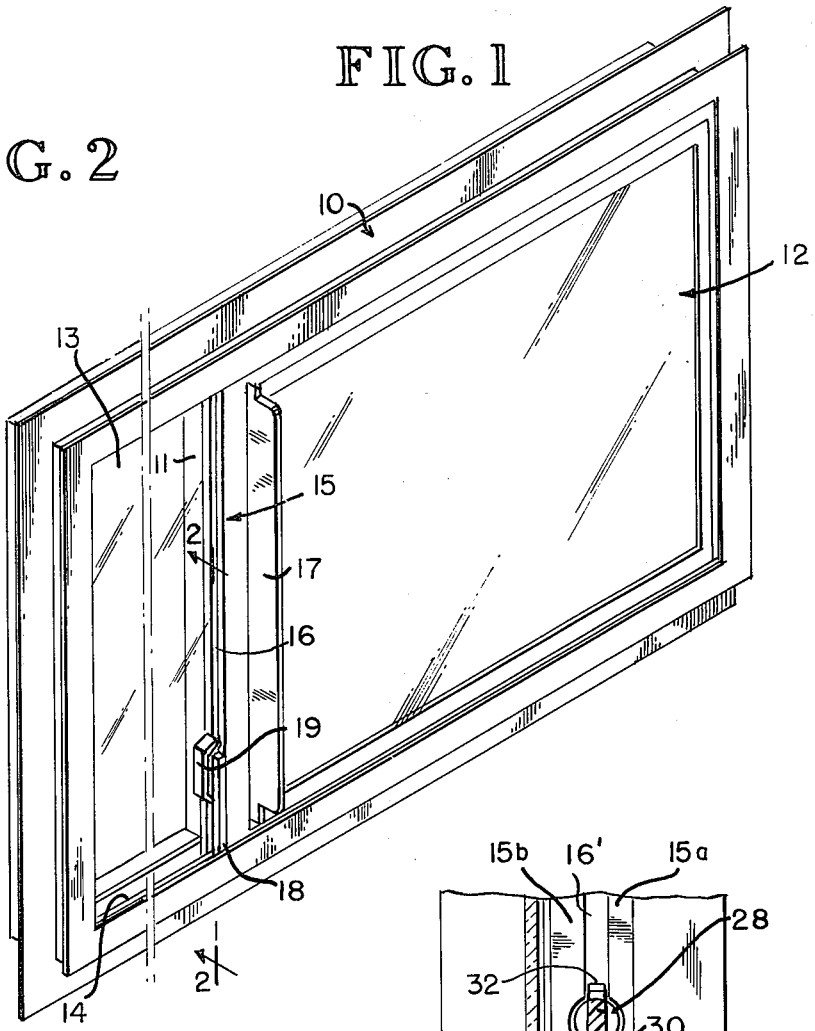
FIG. 1
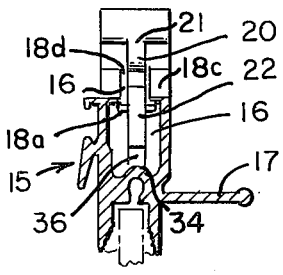
FIG. 4
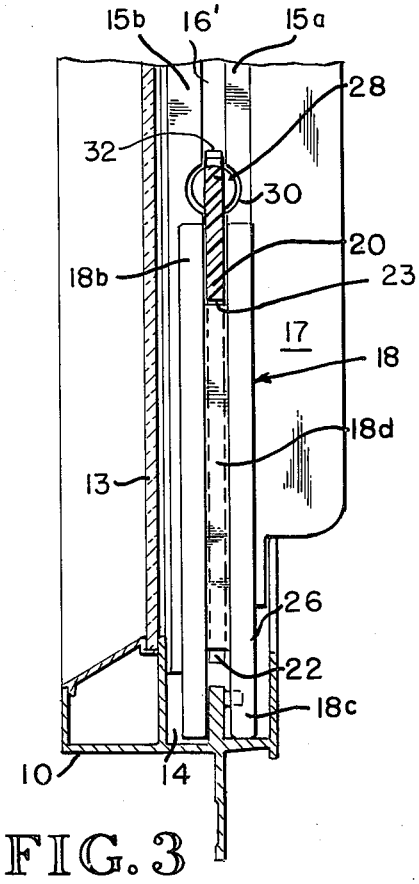
FIG. 3
FIG. 5
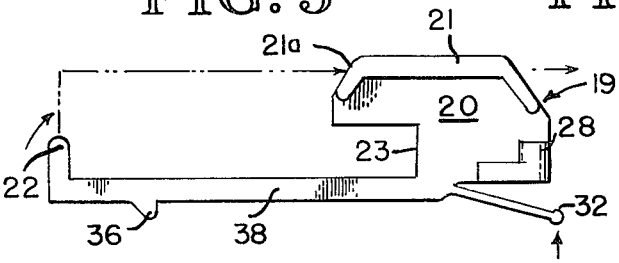

SLIDE BOLT LATCH FOR SLIDING WINDOW VENT

BACKGROUND OF THE INVENTION

1. Field of the Invention

This invention relates to window latches, and more particularly, to a latch with a slide bolt slidingly mounted on a sliding vent in a window frame to register with an aperture in the window frame.

2. Description of the Prior Art

Windows with horizontally sliding vents latched by a vertical slide bolt engaging an aperture in the window frame are commonly used, but in the past they have often not been adequately burglar-proof because of the relative ease with which they can be opened from the outside by force or by jiggling the vent and thereby vibrating open the bolt. Past efforts to positively lock the slide bolt in extended position, as by a set screw or by a pin urged by a compression spring into a detent in the bolt, although resulting in some instances in a more burglar-proof assembly, have the disadvantage that they require a respective specific unlatching motion unrelated to sliding of the bolt before the bolt is free to be axially pushed open. This requirement of such prior art devices is not only inconvenient, but in emergency situations, such as a fire, where the occupant may panic, can be deadly since their complexity may make rapid exit through the window impossible, particularly if the occupant is a child or a stranger to the latch mechanism.

SUMMARY OF THE INVENTION

It is a principal object of the present invention to provide a slide bolt latching device for a sliding vent sash which positively locks the vent in place to prevent entry from the outside and yet is very easy to release, thus permitting an occupant to quickly open the vent in an emergency.

A more particular object is to provide such a device in which an upward push on the bolt mechanism will automatically release the latch on the bolt.

It is a still further object to provide a vent latch which is of unusually simple and economical construction with a minimum of working parts.

These and other objects of the invention are accomplished by providing a one-piece handle mechanism which slides with the bolt and has a projection urged, with the bolt extended, to swing into a stop recess in the guideway by a spring leaf reacting against the back wall of the guideway. Upward force exerted on the handle mechanism to retract the bolt causes the mechanism to pivot back about a point spaced along the guideway from the stop recess and spring and thereby release the bolt.

BRIEF DESCRIPTION OF THE DRAWINGS

FIG. 1 is a fragmentary perspective view showing the vent latch of the present invention installed in a window having a horizontally sliding vent;

FIG. 2 is a vertical cross-sectional view taken along the line 2—2 in FIG. 1 showing the vent latch in both its closed and open positions, the latter being indicated in phantom;

FIG. 3 is a partial cross-sectional view taken along the line 3—3 of FIG. 2;

FIG. 4 is a bottom plan view of the latch taken as indicated by the line 4—4 of FIG. 2 and with the guideway being shown in transverse cross-section; and FIG. 5 is a side view of the handle component of the vent latch.

DETAILED DESCRIPTION OF THE INVENTION

Referring to FIG. 1, for purposes of example the invention has been illustrated applied to a standard window frame 10 of extruded aluminum having a center mullion 11 providing a pair of light openings for a horizontally sliding vent sash 12 and a stationary pane 13. The vent 12 is mounted at the head and sill in opposed quideways 14 bordering the frame 10 indoors of the mullion 11. In the illustrated example, the vent is in its closed position at the right whereat the right jamb of the vent frame interfits with the respective jamb of the frame 10 and the left jamb of the vent frame overlaps the indoors face of the mullion 11. Suitable weather stripping (not shown) is provided in the guideways, interfitting jambs, and between the mullion and the vent. The vent 12 opens to the left by sliding into overlapping relation to the stationary pane 13.

As best shown in FIGS. 2 and 4, the left jamb 15 of the vent frame 12 has an integral elongated handle flange 17 at the front and is formed with a latch guideway 16 for receiving a locking bolt 18. When the bolt 18 is in its lowered latching position, its bottom end projects downwardly into an aperture 26 in the frame 10 to lock the vent from sliding in the guideways 14. A plurality of such apertures can be provided at various points along the lower guideway 14 for securing the vent not only in a fully closed position, but also in partly open position.

The latch guideway 16 has a side opening 16' along its length of reduced width defined by a pair of opposed flanges **15*a*–15*b*. As best seen in FIG. 3, these flanges are notched toward their lower end to collectively provide an enlarged stop recess 30 exposed to the latch guideway 16. The slide bolt 16 is formed with side channels which slidingly interfit with the flanges 15*a*–15*b*** and is preferably formed of metal to resist shock loads in case a forced entry is attempted.

A handle unit 19, best shown in FIG. 5, fits onto the bolt 18 to slide therewith. This handle unit has an elongated backing member 38 which occupies the guideway 16 together with a central body portion **18*a* of reduced length at the back of the slide bolt 18. At its lower end, the backing member 38 has a tab 22 projecting beneath the lower end of the bolt portion 18*a*, and at its upper end has a planar forward extension 20 having a downwardly facing recess providing a recessed face 23 opposing the tab 22. It will be noted from FIG. 3 that the bolt 18 is forked at the top at 18*b* and at the bottom at 18*a*, commencing at the ends of the rear central portion 18*a*. The upper forks 18*b* straddle the planar extension 20 of the handle unit to hold the latter against lateral movement relative to the slide bolt 18 before insertion in the guideway 16, while the tab 22 and face 23** restrict endwise movement of the handle unit relative to the bolt.

From the foregoing description, it will be seen that the slide bolt 18 and handle unit 19 can be easily assembled together as a unit by first moving the forks **18*b* endwise over the handle portion 20 with the lower end of the bolt tilted forwardly relative to the bolt until the upper end of the back central portion 18*a* of the bolt engages the end face 23. Then the lower end of the bolt is swung rearwardly to bring the tab 22 beneath the central portion 18*a*. It will be noted that at the front, the slide bolt 18 has a longitudinal channel groove 18*d*,** part way into which extends the rear vertical edge portion of the planar part 20, which adjoins the front end of recessed face 23. This arrangement permits the relative motion between the slide bolt and handle shown by the full line and broken line positions thereof in FIG. 2.

Continuing with the configuration of the handle unit 19, at the extreme front the planar portion 20 has handle flanges 21 extending in the indoors and outdoors directions. The bottom portion of these flanges presents a sloped engagement face 21*a*. At the rear of the planar portion 20, the handle unit is formed with a forwardly facing key 28 arching from both sides, as seen in FIG. 3, and a resilient spring leaf 32 sloping upwardly in the rearward direction. In its relaxed condition, the spring leaf 32 projects rearwardly of the plane of the backing member 38 and is complemented in this respect by a rearwardly projecting fulcrum 36 located adjacent the lower end of the backing member and engaging the back wall 34 of the guideway, thereby providing moment arms between the fulcrum and the spring leaf 32 and between the fulcrum and the sloped engagement face 21*a*.

The handle unit 19 is formed of a suitable resilient plastic material to give the leaf 32 the proper spring characteristic to positively urge the key 28 forwardly against the guideway flanges 15*a*–15*b* when the leaf 32 is bent forwardly by crowding of the key and leaf into the guideway 16 as shown by the phantom position of the handle unit at the top of FIG. 2. Hence, when the bottom forks 18*c* register with the apertures 26 in the window frame, at which time the keys 28 are opposite the stop recesses 30 in the flanges 15*a*–15*b*, the keys 28 will automatically swing forwardly about the fulcrum 36 to their solid line position in FIG. 2 whereat the keys 28 register with the stop recesses 30 to prevent the bolt 18 from being dislodged from its vent locking position.

To release the bolt from the indoors side of the window, the sloped handle face 21*a* is manually pushed upwardly as indicated by the phantom line arrow adjoining the 21*a* designation in FIG. 5. This upward pressure results in a force component opposing that of the spring 32, and thereby causes the handle unit 19 to swing rearwardly about the fulcrum 36 and compress the spring 32 into the phantom line position of FIG. 2, thereby freeing the keys 28 so that the bolt 18 can slide upwardly in response to continued upward manual pressure on the handle 21. Part of the rearward swinging action of the handle unit 19 responsive to upward pressure on the sloped handle portion 21*a* can be accomplished by spring bending of the backing member 38 if such is fairly resilient. In other words, the backing member need not be rigid and can have a spring effect supplementing that of the leaf spring 32.

From the foregoing description, it is seen that a positive locking of the slide bolt occurs automatically when the bolt is pushed downwardly into vent locking position, and that the bolt is automatically released responsive to upward pressure on the handle. Since the exertion of an upward manual force on the handle unit 19 is that which a person would normally apply to release a slide bolt, even if the person were not familiar with the mechanism, no delay will normally be experienced in opening the vent under emergency conditions.

The embodiments of the invention in which a particular property or privilege is claimed are defined as follows:

1. In a vent frame adapted to slide along a vent guideway formed in a window frame having an aperture therein, a vent latch comprising:

a latch guideway formed in said vent frame having a slide axis arranged to register with said aperture when the vent frame is in a preselected position;

a slide bolt in said latch guideway and interfitting with said vent frame to slide along said slide axis;

a retaining stop formed in said latch guideway;

a latching member carried by said bolt, said latching member having a projection adapted to interact with said stop when the bolt is in registering position with said aperture;

resilient means for yieldingly urging said projection into engagement with said stop;

a handle; and means for translating a manual bolt retracting force exerted on said handle in a direction away from said aperture into an unlatching force component opposed to said resilient means whereby said projection is disengaged from said stop responsive to commencement of retraction of the bolt, said force-translating means including anchoring means on said latching member for limiting relative movement between said latching member and said bolt along said slide axis and permitting limited movement of the latching member toward and away from the back of said latch guideway at said resilient means, said resilient means reacting against said vent frame at the back of said latch guideway and said retaining stop being located at the front of said latch guideway whereby said projection is disengaged from said stop responsive to commencement of retraction of the bolt.

2. A vent latch as in claim 1 wherein said resilient means and anchoring means are integral parts of said latching member, and said latching member has an integral fulcrum spaced from said resilient means and said handle in a direction axial of said guideway.

3. In a vent frame adapted to slide along a vent guideway formed in a window frame having an aperture therein, a vent latch comprising:

a latch guideway formed in said vent frame having a slide axis arranged to register with said aperture when the vent frame is in a preselected position;

a slide bolt in said latch guideway and interfitting with said vent frame to slide along said slide axis;

a retaining stop formed in said latch guideway;

a latching member carried by said bolt, said latching member having a projection adapted to interact with said stop when the bolt is in registering position with said aperture;

a handle;

a backing member including means for preventing relative movement between said backing member and said bolt along the axis of said backing member;

a resilient leaf extending from said backing member in a direction opposite from said handle, said leaf exerting a force between said vent frame and said latching member; and means for translating a manual bolt retracting force exerted on said handle in a direction away from said aperture into an unlatching force component opposed to the force exerted by said resilient leaf whereby said projection is disengaged from said stop responsive to commencement of retraction of the bolt.

4. A vent latch as in claim 3 wherein said latching member is a unitary structure respecting said backing member, handle and leaf.

5. A slide bolt assembly for use in a guideway having a back wall, a narrowed front longitudinal opening, and a rearwardly exposed detent adjoining said opening, said assembly comprising:

an elongated backing member adapted to slide in said guideway and having a rearwardly projecting fulcrum and a rear spring leaf arranged and adapted to engage said back wall at longitudinally spaced locations so that the spring leaf will yieldingly urge the backing member to swing forwardly from said fulcrum, said backing member having a forwardly extending latching stop arranged to register with said detent responsive to such spring-urged forward swinging of the backing member when the stop is opposite said detent;

a slide bolt adapted to occupy said front opening and interfitting with said backing member to slide in unison therewith while leaving the backing member free to swing in the aforesaid manner a limited amount relative to the slide bolt; and a front handle on the backing member spaced longitudinally toward the spring leaf from the fulcrum and projecting forwardly of the slide bolt for releasing the stop from the detent and sliding the slide bolt.

6. A slide bolt assembly according to claim 5 in which said spring leaf is integral with said backing member.

7. A slide bolt assembly according to claim 5 in which said handle, fulcrum and spring leaf are integral with said backing member.

8. A slide bolt assembly according to claim 5 in which said bolt has a pair of longitudinal grooves along its opposite side edges for slidingly interfitting with the structure defining said front opening of the guideway.

9. A slide bolt assembly for a guideway of the type having a back wall and at least one front guide flange defining a narrowed mouth opposite the back wall and with said flange being recessed intermediate its ends adjacent one end of the guideway to form a detent exposed to the guideway;

a slide bolt having a longitudinal side channel for slidingly interfitting with said guideway flange and having a locking extension arranged to project endwise beyond said side channel at said one end of the guideway when the bolt is in locking position; and a one-piece latching unit detachably interfitting with said bolt to move endwise therewith, said unit having a unitary front handle overlying the bolt, a unitary back member extending along a major part of the back of the bolt and having a unitary rearwardly projecting fulcrum near the locking extension and a unitary rearwardly projecting spring leaf near the handle, and said unit having a unitary front stop between the spring leaf and the handle to interact with said detent.

10. A slide bolt assembly according to claim 9 in which said slide bolt has a fork extension at its end opposite from said locking extension and which interfits with said latching unit behind said handle.

11. A slide bolt assembly according to claim 9 in which said locking extension is spaced from the back of the slide bolt by an end shoulder, and said backing member has a unitary forwardly projecting tab at its fulcrum end arranged to engage said shoulder.

12. A slide bolt assembly according to claim 11 in which said latching unit has a recess spaced behind its handle and facing toward said shoulder, said slide bolt extending into said recess and having a forked end portion straddling the latching unit.

13. A slide bolt assembly according to claim 12 in which said slide bolt has a front longitudinal channel terminating at the center of said forked end portion, said front channel being partly occupied by the portion of said latching unit located between said handle and said recess.

* * * * *